US006419090B1

(12) United States Patent
Focke et al.

(10) Patent No.: US 6,419,090 B1
(45) Date of Patent: Jul. 16, 2002

(54) TRAY PACK FOR A GROUP OF ARTICLES, AND PROCESS AND APPARATUS FOR PRODUCING THE SAME

(75) Inventors: Heinz Focke, Verden; Hugo Mutschall, Kirchlinteln, both of (DE)

(73) Assignee: Focke & Co. (GmbH & Co.), Verden (DE)

( * ) Notice: Subject to any disclaimer, the term of this patent is extended or adjusted under 35 U.S.C. 154(b) by 0 days.

(21) Appl. No.: 09/357,449

(22) Filed: Jul. 20, 1999

(30) Foreign Application Priority Data

Jul. 28, 1998 (DE) ..... 198 34 024

(51) Int. Cl.[7] ..... B65D 85/00

(52) U.S. Cl. ..... 206/526; 206/557; 229/933; 229/936

(58) Field of Search ..... 206/526, 557, 206/449, 427, 772, 774, 775; 229/933, 935, 117.13, 164, 132, 136, 173, 918, 915, 183

(56) References Cited

U.S. PATENT DOCUMENTS

| | | | | | |
|---|---|---|---|---|---|
| 2,529,725 | A | * | 11/1950 | Currie | 229/925 |
| 2,675,956 | A | * | 4/1954 | Currie | 229/935 |
| 2,762,550 | A | * | 9/1956 | Goettsch et al. | 229/935 |
| 3,055,573 | A | * | 9/1962 | Carter | 229/164 |
| 3,593,493 | A | | 7/1971 | Alduk | |
| 4,179,866 | A | | 12/1979 | Graham et al. | |
| 4,815,592 | A | * | 3/1989 | Kunkel | 206/242 |
| 5,390,847 | A | * | 2/1995 | Young | 229/918 |
| 5,992,735 | A | * | 11/1999 | Oosterbaan | 229/191 |

FOREIGN PATENT DOCUMENTS

| | | |
|---|---|---|
| DE | 37 08 896 A1 | 1/1988 |
| DE | 38 35 254 A1 | 4/1990 |
| DE | 195 35 820 A1 | 3/1997 |
| FR | 2 435 397 A1 | 4/1980 |
| FR | 27 19 029 A1 | 10/1995 |
| GB | 884 179 A | 12/1961 |

* cited by examiner

*Primary Examiner*—Shian Luong
(74) *Attorney, Agent, or Firm*—Todd Deveau; Ryan A. Schneider; Troutman Sanders LLP

(57) ABSTRACT

Tray packs (12) are packs made of cardboard or the like which are open at the top and have side walls, namely longitudinal walls (13, 14) and transverse walls (15, 16), of a low height. In order to improve the dimensional stability of the tray pack (12), upright corner supports 925, 26) which are angled in cross section are provided in the region of corners, the height of said corner supports corresponding approximately to the height of the individual packs or articles. A base wall (17) comprises base tabs, namely transverse tabs (18, 19) and longitudinal tabs (20, 21), which correspond, in shape and size, to recesses (29, 30) which are formed above the side walls (13 . . . 16) in conjunction with the corner supports (25, 26). This means that blanks for the tray pack (12) can be produced in a largely waste-free manner from a continuous material web.

2 Claims, 5 Drawing Sheets

Figure 1:
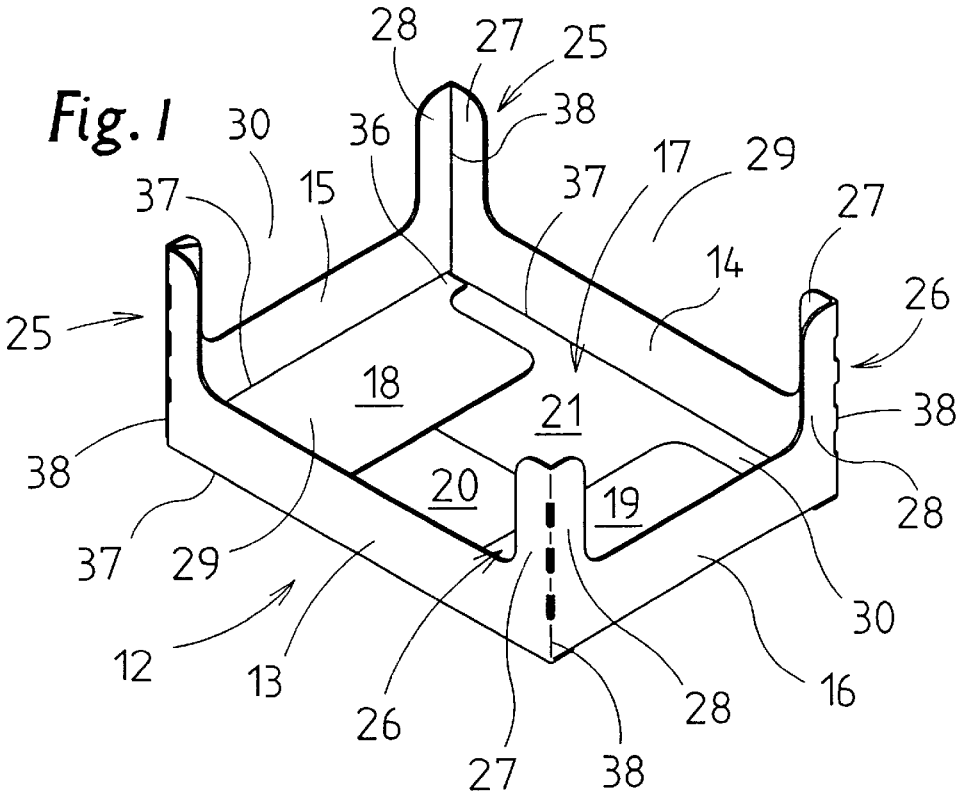

Fig. 7
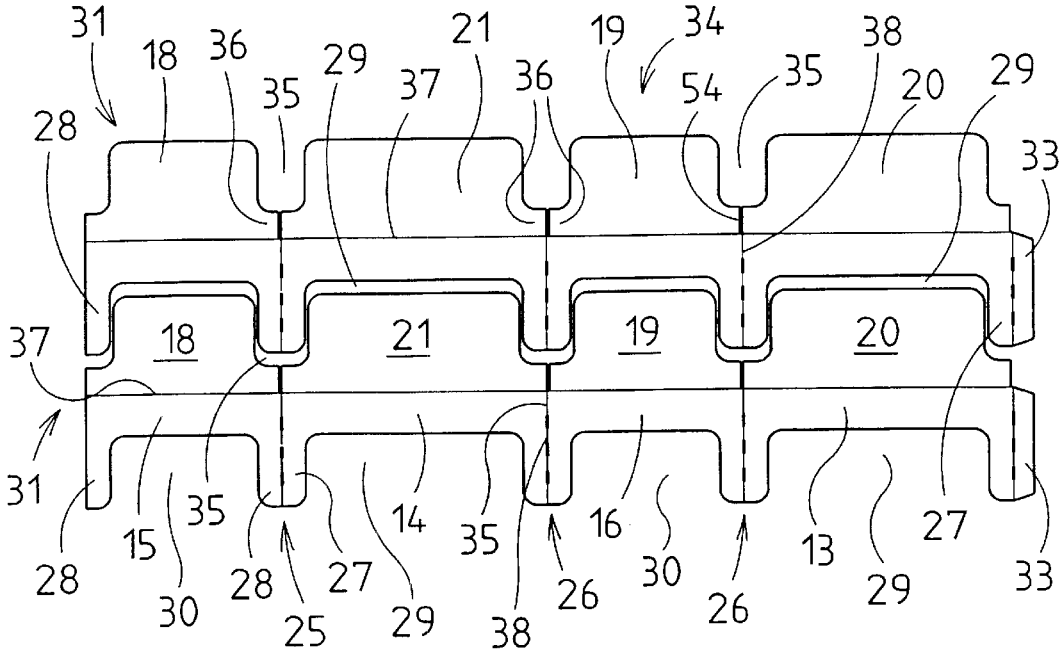
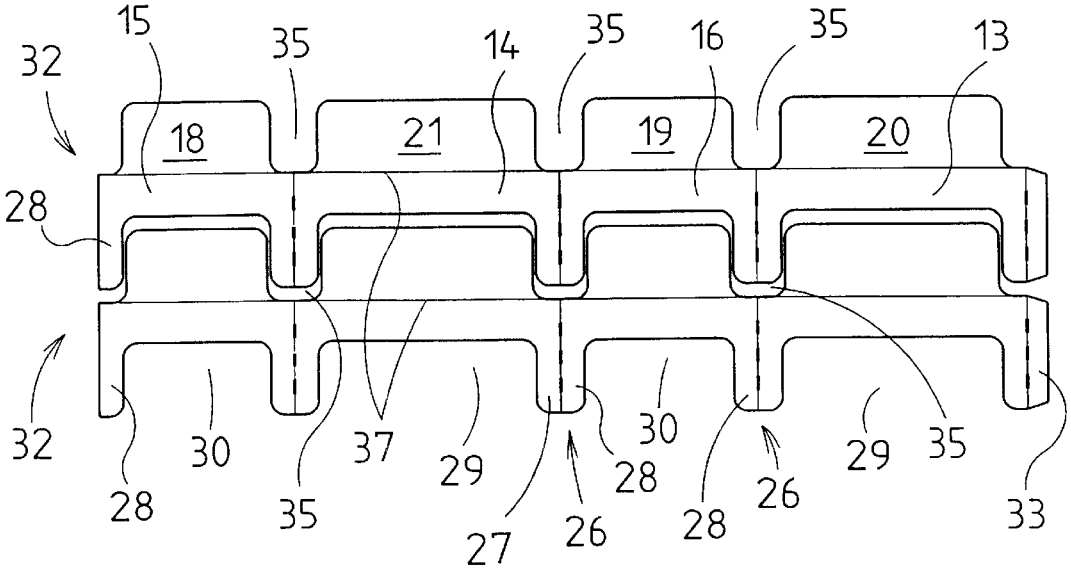
Fig. 8

TRAY PACK FOR A GROUP OF ARTICLES, AND PROCESS AND APPARATUS FOR PRODUCING THE SAME

SUMMARY OF THE INVENTION

The invention relates to a pack for a group of articles, in particular individual packs, comprising a base wall, lateral longitudinal walls, lateral transverse walls and upright corner supports which project beyond the longitudinal walls and transverse walls—a so-called tray pack. The invention also relates to a process and apparatus for producing and filling such packs.

Tray packs are usually pack containers which are open at the top and comprise a base wall and side walls, namely longitudinal walls and transverse walls, which are lower than the articles which are to be packed. In the present case, the tray pack is designed such that, in the region of the (four) pack corners, upright corner supports are formed by the longitudinal walls and transverse walls, said corner supports being considerably higher than the longitudinal walls and transverse walls. The corner supports, which extend around the corner and are thus angled in cross section, provide the pack contents with additional support. A tray pack designed in this way is intended, in particular, for receiving cuboidal individual packs.

A special feature of tray packs is that the outlay on material, namely paperboard or corrugated paperboard, is comparatively low.

The object of the invention is to reduce the outlay on material further by virtue of an appropriate configuration of the pack and without reducing the functionality or the dimensional stability of the pack.

In order to achieve this object, the pack according to the invention is characterized in that the base wall is formed from base tabs—longitudinal tabs and transverse tabs—which are connected to the associated longitudinal walls and transverse walls and the dimensions of which are smaller than or equal to recesses which are formed between adjacent corner supports.

The design of the pack with (low) longitudinal walls and transverse walls, on the one hand, and higher corner supports, on the other hand, results in upwardly open recesses, in the region of the longitudinal walls and transverse walls, which are bounded laterally by the corner supports. The base tabs are designed such that they are preferably of precisely the same shape and size as these recesses. This makes it possible for the blanks for the pack designed in this way to be produced in a waste-free manner from a continuous material web made of preferably stiff packaging material.

The blanks for a pack within the context of the invention may be designed such that the partially overlapping base tabs produce a closed base wall. Alternatively, that is to say in the case of a configuration of the blank for maximum savings in terms of materials, the base wall is provided with openings or recesses on account of the base tabs being of smaller dimensions. However, said openings and recesses are smaller or narrower than the individual packs or articles which are to be set down on the base wall.

A further special feature is the production and filling of such or similar (tray) packs which are open at the top. According to the invention, the procedure is thus such that the pack is transported with the open base wall, that is to say non-folded base tabs, oriented upwards and the pack contents are introduced into the pack via the base wall.

Thereafter, the base tabs are folded in a favorable sequence. Following completion of the base wall, the complete, filled pack is turned through 180°, with the result that the base wall is directed downwards. An apparatus of suitable design is provided for carrying out the process.

DETAILED DESCRIPTION OF THE DRAWINGS

Figure 2:
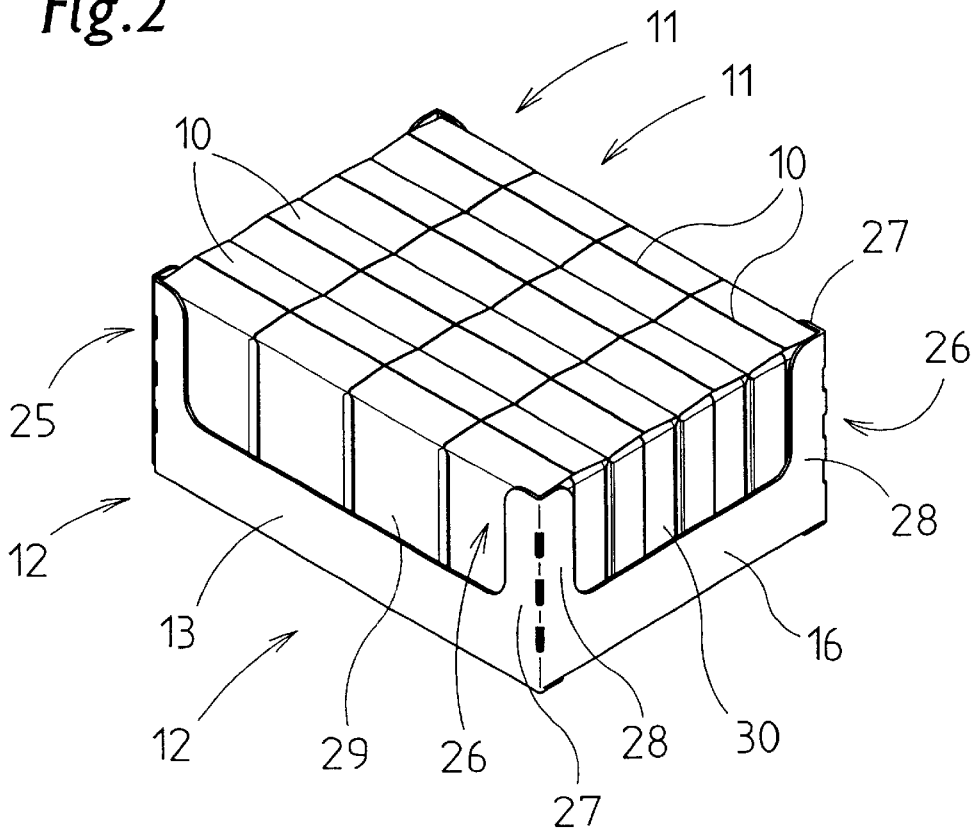
Figure 3:
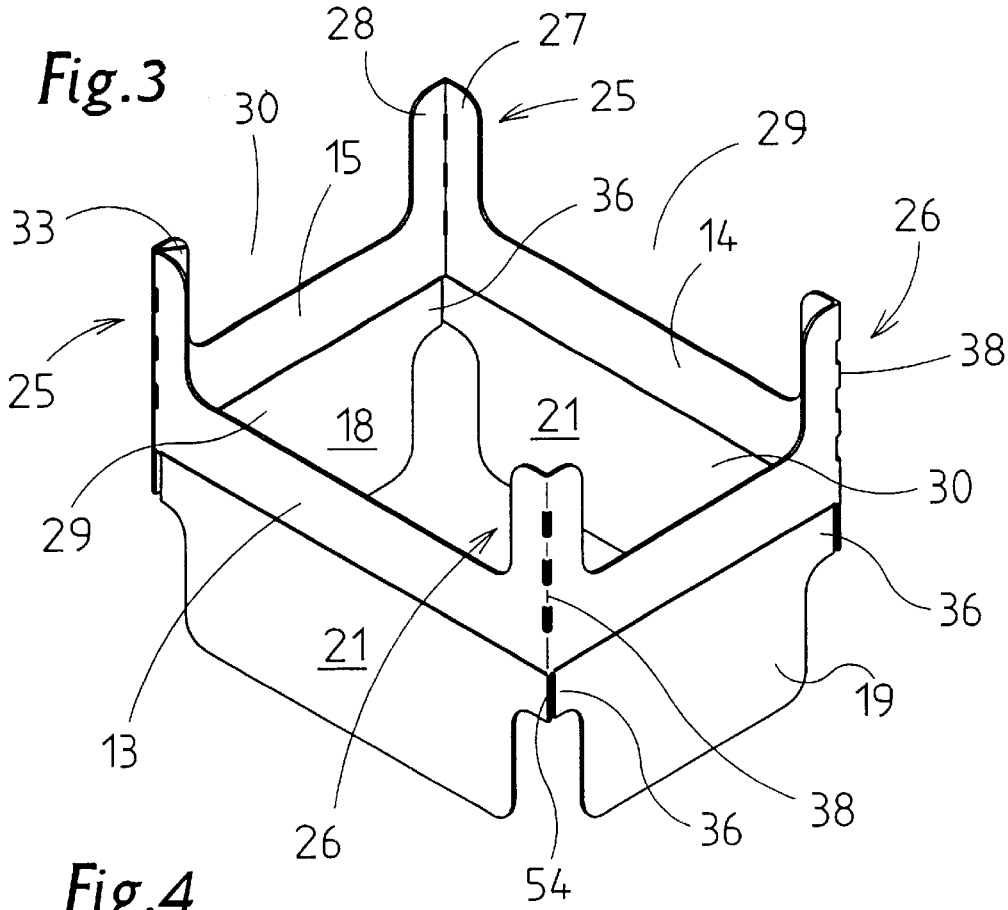
Figure 4:
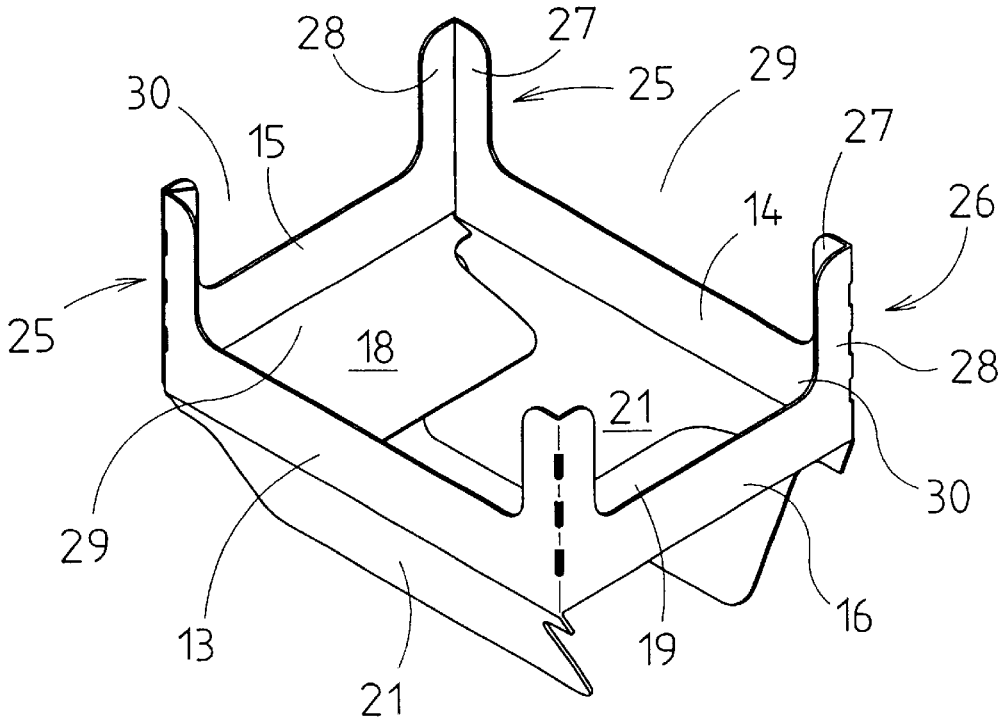
Figure 5:
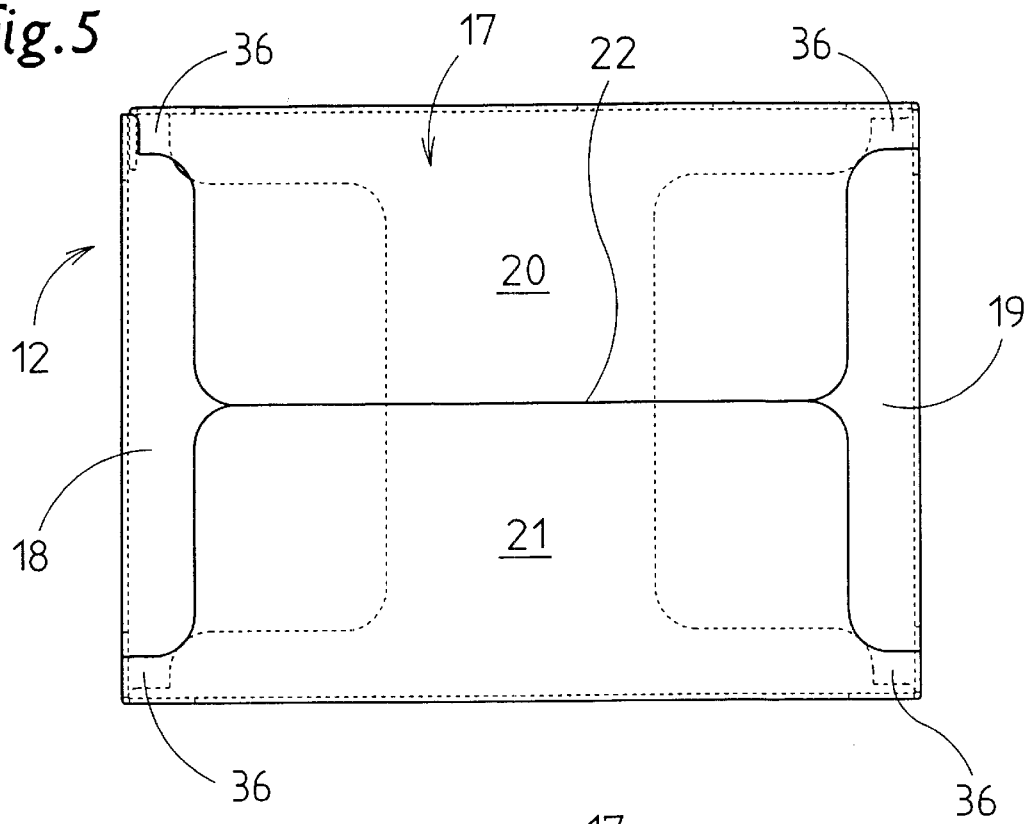
Figure 6:
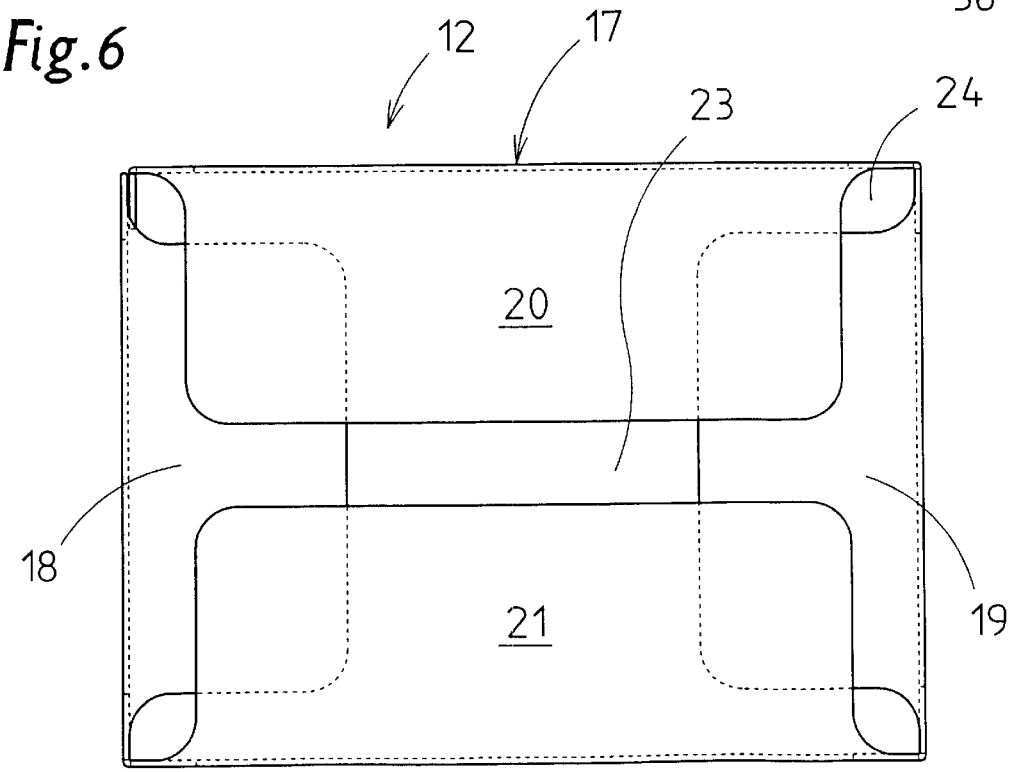
Figure 9:
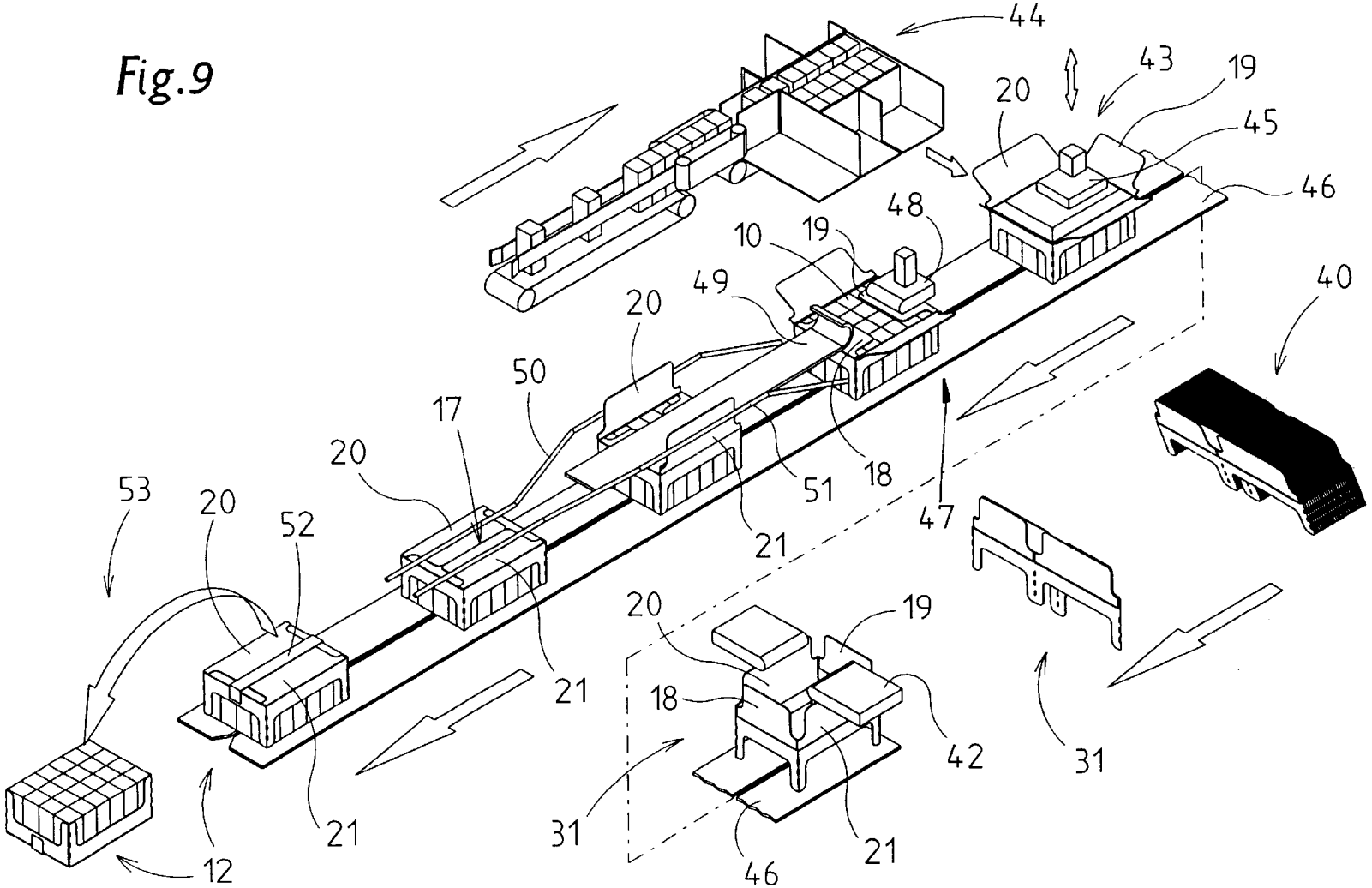

Further details of the pack and of the production process and of the apparatus are explained in more detail hereinbelow with reference to the drawings, in which:

FIG. 1 shows a perspective illustration of a finished tray pack which has not been filled, FIG. 2 shows the tray pack according to FIG. 1 in the filled state, FIG. 3 shows another embodiment of the tray pack with non-folded base tabs, likewise in a perspective illustration, FIG. 4 shows the finished tray pack, which has not been filled, of the embodiment according to FIG. 3, FIG. 5 shows a bottom view of the tray pack according to FIG. 1, FIG. 6 shows a bottom view of the tray pack according to FIG. 4, FIG. 7 shows a section of a material web for producing blanks for tray packs according to FIG. 1, FIG. 8 shows a section of a material web for producing blanks for tray packs according to FIGS. 3 and 4, and FIG. 9 shows a perspective, schematic illustration of an apparatus or installation for producing and filling tray packs.

DETAILED DESCRIPTION OF THE INVENTION

The pack illustrated in the drawings serves for receiving groups of articles, namely individual packs 10. The latter are of cuboidal design and are positioned in ordered pack rows 11. The individual packs 10 may be packs of milk or other liquids, but also packs for piece goods or granular materials.

The pack for receiving the individual packs 10 is a tray pack 12. This is the type of pack which has comparatively low side walls, namely longitudinal walls 13, 14 and transverse walls 15, 16. The individual packs 10, or the pack contents formed therefrom, rest on a base wall 17. The pack or tray pack 12 is dimensioned such that the base wall 17 is completely covered by the group of individual packs 10. Accordingly, the tray pack 12 is completely filled by the pack contents.

The base wall 17 comprises a plurality of folding tabs which are connected to the upright side walls and partially overlap for forming the base wall 17. Inner or top transverse tabs 18, 19 are connected to the associated traverse walls 15 and 16 and are folded into the plane of the base wall 17. Longitudinal tabs 20, 21 are directed downwards or outwards and are connected to the longitudinal walls 13, 14 in each case. The folding tabs which form the base wall 17 may be of different dimensions. In the case of the exemplary embodiment according to FIGS. 1 and 5 (bottom view of the base wall 17), the folding tabs, namely transverse tabs 18, 19 and longitudinal tabs 20, 21, are dimensioned so as to produce a closed, gap-free base wall 17. In this case, the longitudinal tabs 20, 21 are dimensioned such that their width corresponds in each case to half the width of the base wall 17. The longitudinal tabs 20, 21, of the same size in this example, butt against one another along a central parting line 22.

In the case of the exemplary embodiment according to FIG. 6 (bottom view of the base wall 17), folding tabs of smaller dimensions are provided. The transverse tabs 18, 19 and, correspondingly, the longitudinal tabs 20, 21 are of a lesser width (transverse dimension). This means that there is no overlapping of the folding tabs in the subregion. An elongate, rectangular opening 23 is produced in the central region of the base wall 17. Further openings 24, which are of corresponding design, are produced at corners of the tray pack 12 or of the base wall 17. All the openings 23, 24 of the base wall 17 are configured and/or dimensioned so as to provide sufficient support for the individual packs 10, to be precise on account of the dimensions and/or of the positioning of the individual packs 10 on the base wall 17.

A special feature of the tray pack 12 is that the side walls 13 . . . 16, which are of a low height, merge into upright corner supports 25, 26 in the region of pack corners. Said corner supports are of angled design in cross section and enclose those corner regions of the individual packs 10 positioned at the corners which are directed towards them. The corner supports 25, 26 are of approximately the same height as the individual packs 10 or project beyond them to a slight extent. Each corner support 25, 26 comprises two legs 27, 28 which are arranged at right angles to one another and are each assigned to an associated side wall, namely longitudinal wall 13, 14 or transverse wall 15, 16.

The corner supports 25, 26, or the legs 27, 28 thereof, merge with a rounded contour into the respectively associated side wall 13 . . . 16. The legs 27, 28 each bound upwardly open recesses 29, 30 in the side walls 13 . . . 16. The recesses 29, 30 are produced by appropriate punching-out operations, to be precise the folding tabs of the base wall 17 being formed in the process. The recesses 29 in the longitudinal walls 13, 14 or above the same, correspond in shape and size to the longitudinal tabs 20, 21 of the base wall. The same applies to the transverse tabs 18, 19, which correspond to the recesses 30 in the region of the transverse walls 15, 16.

The configuration of the tray pack 12 allows the latter to be produced from material-saving blanks 31, 32. These are strip-like, open-ended structures which can be positioned around the contents, that is to say around the group of individual packs 10. In order to form a tray pack 12 which is closed all the way round, a connecting strip 33 is provided at one end of the blanks 31, 32 for the purpose of connection to the other, opposite end of the blank 31, 32. In the present case, the ends of the blanks 31, 32 are connected to one another in the region of a corner support 25. The relevant corner support 25 is thus divided between the two legs 27, 28. The latter are connected, in particular adhesively bonded, on the inside by the connecting strip 33, the corner support 25 being formed in the process.

The blanks 31, 32 are produced by virtue of being stamped from a larger piece of material, in particular from a material web 34 made of cardboard, corrugated cardboard or the like. The blanks 31, 32 extend in the transverse direction within the material web 34, and are accordingly severed from the material web 34 by transversely directed punch cuts. In this case, the punch cut follows the contour of the blanks 31, 32.

The coordinated configuration and dimensioning of the base tabs 18 . . . 21, on the one hand, and of the recesses 29, 30, on the other hand, means that the blanks 31, 32 can be severed in a waste-free manner from the material web 34, apart from small remnants in the region of the connecting strips 33. In this case, the base tabs 18 . . . 21 of a blank fit in the recesses 29, 30 of an adjacent blank 31, 32. The corner supports 25, 26 form depressions 35 between the base tabs 18 . . . 21 of the adjacent blank.

There are various possible ways of configuring the blanks 31, 32. In the case of the exemplary embodiment of FIG. 7, the base tabs 18 . . . 21 are configured with larger transverse dimensions, to be precise by virtue of webs 36 as a widened portion of the base tabs 18 . . . 21 and for bounding the depressions 35. The latter terminate at a distance from a folding edge 37, which delimits the base wall 17 from the side walls 13 . . . 16. As a result, in the case of this exemplary embodiment (FIG. 4), the base tabs 18 . . . 21 are dimensioned so as to produce an opening-free base wall 17 which is closed throughout (FIG. 5). The webs 36 are severed by punch lines 54, to be precise in extension of the corner edges 38.

The blanks 32 according to FIG. 8 require still less material than do the blanks for FIG. 7. The base tabs 18 . . . 21 have reduced transverse dimensions. The depressions 35 extend as far as the folding edge 37. This gives a configuration of the base wall 17 corresponding to FIG. 6, that is to say with the openings 23 and 24.

For easier folding, perforations 39 are provided in the region of corner edges 38, and these perforations make it easier to bend the legs 27, 28 during the production of the tray pack 12.

A particular production and filling process for such tray packs 12 is shown in FIG. 9 with reference to a schematically illustrated installation.

For this purpose, the blanks 31, 32 are prepared by virtue of the connecting strip 33 being connected to the associated leg 28 at the free, opposite end. The blanks 31, 32 closed in this way are collapsed in the flat state, with corresponding deformation in the region of diametrically opposite corner edges 38. These flat, intermediate structures are held ready, in an upright or obliquely inclined position, in a blank magazine 40 and are removed individually from the blank magazine 40.

In the region of a first folding station, the blanks 31, 32 are folded into the three-dimensional configuration, to be precise such that the open side and the corner supports 25, 26 are directed downwards, but the base tabs 18 . . . 21 are directed upwards. In the same folding station 41, the base tabs 18 . . . 21 are folded outwards into a funnel-like position by pressure-exerting elements 42, as is shown with reference to a downstream filling station 43.

In the region of said filling station 43, the tray pack 12 is filled via the open, upwardly oriented base wall 17. For this purpose, the finished individual packs 10, corresponding to the contents of a tray pack 12, are brought together in the region of a grouping station 44. A lifting conveyor with a lifting head 45, said conveyor not being illustrated specifically, grips the group of individual packs 10 and positions them in the track pack 12, above. In this case, the corner supports 25, 26 rest on a panel like box path 46. The grouping station 44 and lifting head 45 or lifting conveyor are expediently designed in accordance with DE 197 00 150.5.

The filled tray pack 12, with the open base wall 17 oriented upwards, passes into a first base-folding station 47. In the latter, stationary and moveable folding elements 48 and 49 fold against the group of individual packs 10 those base tabs which are oriented transversely to the conveying direction, namely the transverse tabs 18 and 19. The transverse tab 18, which is located at the front in the conveying direction, is folded over by the fixed, strip-like folding element 49, on account of the conveying movement of the tray pack 12. The rear transverse tab 19 is folded into the same position by the moveable folding element 48.

During further transportation, folding diverters arranged to the side of the movement path of the tray pack 12, namely specifically formed folding rails 50, 51 take effect. These grip the associated base tabs, namely longitudinal tabs 20, 21, on the outside. By virtue of appropriate shaping, the longitudinal tabs 20, 21 are folded over, during transportation of the tray pack 12, first of all into an upright position and then until they butt against the individual packs 10 or against the already folded transverse tabs 18, 19.

The base wall 17 which has been folded to completion in this way is fixed in position, for example by virtue of the base tabs 18 . . . 21 being connected to one another. In the case of the present exemplary embodiment, an adhesive strip 52 is applied to the base wall 17 in the longitudinal direction in order to connect the outer longitudinal tabs 20, 21 to one another in the region of the parting line 22. In order to render the tray pack 12 stable, the adhesive strip 52 has legs extending in the region of the adjacent side walls, namely transverse walls 15, 16.

Once the base wall 17 has been fixed, the finished tray pack 12 is turned through 180° in the conveying direction in the region of a turning station 53, this placing the tray pack 12 in a position in which it is ready for dispatch.

| List of designations: | |
|---|---|
| 10 Individual pack | 41 Folding station |
| 11 Row of packs | 42 Pressure-exerting element |
| 12 Tray pack | 43 Filling station |
| 13 Longitudinal wall | 44 Grouping station |
| 14 Longitudinal wall | 45 Lifting head |
| 15 Transverse wall | 46 Box path |
| 16 Transverse wall | 47 Base-folding station |
| 17 Base wall | 48 Folding element |
| 18 Transverse tab | 49 Folding element |
| 19 Transverse tab | 50 Folding rail |
| 20 Longitudinal tab | 51 Folding rail |
| 21 Longitudinal tab | 52 Adhesive strip |
| 22 Parting line | 53 Turning station |
| 23 Opening | 54 Punch Line |
| 24 Opening | |
| 25 Corner support | |

-continued

| List of designations: |
|---|
| 26 Corner support |
| 27 Leg |
| 28 Leg |
| 29 Recess |
| 30 Recess |
| 31 Blank |
| 32 Blank |
| 33 Connecting strip |
| 34 Material web |
| 35 Depression |
| 36 Web |
| 37 Folding edge |
| 38 Corner edge |
| 39 Perforation |
| 40 Blank magazine |

What is claimed:

1. Pack for a group of articles comprising a base wall, lateral longitudinal walls, lateral transverse walls and upright comer supports which project beyond the longitudinal walls and transverse walls to form a tray pack, wherein the base wall is formed from longitudinal base tabs and transverse base tabs which are connected to the associated longitudinal walls and transverse walls and at least one tab of which corresponds, in terms of shape and size, to recesses formed, between adjacent comer supports, in the region of the longitudinal walls and/or of the transverse walls, wherein the longitudinal tabs have a widened material strip or web, which is directed towards the longitudinal walls, such that the longitudinal tabs preferably correspond to half the width of the base wall in each case and butt against one another in the region of a central parting line.

2. Pack according to claim 1, wherein the transverse base tabs of the base wall are connected to the transverse walls and have a widened portion corresponding to the web, and in that base wall formed from transverse tabs and longitudinal tabs designed in this way is closed throughout so that the base wall is free of openings.

* * * * *